US007811053B2

(12) United States Patent
Balamucki et al.

(10) Patent No.: US 7,811,053 B2
(45) Date of Patent: Oct. 12, 2010

(54) FAN ROTOR DESIGN FOR COINCIDENCE AVOIDANCE

(75) Inventors: Stanley J. Balamucki, Marlborough, CT (US); Eric W. Malmborg, Amston, CT (US)

(73) Assignee: United Technologies Corporation, Hartford, CT (US)

( * ) Notice: Subject to any disclaimer, the term of this patent is extended or adjusted under 35 U.S.C. 154(b) by 589 days.

(21) Appl. No.: 11/188,037

(22) Filed: Jul. 22, 2005

(65) Prior Publication Data

US 2007/0020101 A1 Jan. 25, 2007

(51) Int. Cl.
*F01D 5/30* (2006.01)

(52) U.S. Cl. ..... 415/173.1; 415/9; 415/173.4; 416/203; 416/219 R; 416/193 A

(58) Field of Classification Search ..... 415/9, 415/119, 173.1, 173.4; 416/175, 203, 219 R, 416/220 R, 234, 248, 193 A, 198 A, 201 R
See application file for complete search history.

(56) References Cited

U.S. PATENT DOCUMENTS

| | | | | | |
|---|---|---|---|---|---|
| 2,432,315 | A | * | 12/1947 | Howard | 416/213 R |
| 2,781,998 | A | * | 2/1957 | Barr | 416/220 R |
| 2,948,506 | A | * | 8/1960 | Glasser et al. | 415/191 |
| 3,575,530 | A | | 4/1971 | Hall | |
| 3,692,429 | A | * | 9/1972 | Redding | 416/201 R |
| 4,512,718 | A | * | 4/1985 | Stargardter | 416/231 B |
| 4,621,979 | A | * | 11/1986 | Zipps et al. | 416/219 R |
| 4,688,992 | A | * | 8/1987 | Kirkpatrick et al. | 416/248 |
| 5,160,242 | A | | 11/1992 | Brown | |
| 6,042,388 | A | | 3/2000 | Tustaniwskyj et al. | |
| 6,338,609 | B1 | * | 1/2002 | Decker et al. | 415/173.1 |
| 6,648,602 | B2 | | 11/2003 | Horng et al. | |
| 7,048,507 | B2 | * | 5/2006 | Wettstein et al. | 416/203 |
| 2008/0134504 | A1 | | 6/2008 | Schoenenborn | |

FOREIGN PATENT DOCUMENTS

| | | | | | |
|---|---|---|---|---|---|
| DE | 4439726 | A1 | | 5/1996 | |
| GB | 2153447 | A | * | 8/1985 | |
| GB | 2225388 | A | * | 5/1990 | 415/173.4 |
| JP | 54-32808 | | * | 3/1979 | 416/203 |

OTHER PUBLICATIONS

European Search Report for EP 06253845.9, dated Nov. 28, 2008.

* cited by examiner

*Primary Examiner*—Christopher Verdier
(74) *Attorney, Agent, or Firm*—Bachman & LaPointe, P.C.

(57) ABSTRACT

A fan rotor capable of avoiding coincidence will include a fan hub comprising one or more slots each designed to receive a fan blade; and one or more fan blades disposed within the slots. One or more slots will comprise an $R_Z$ baseline and have one or more second fan blades disposed therein while another set of slots will have an $R_Z$ baseline having one or more first fan blades disposed therein. The tips of the second fan blades will be positioned at a distance farther from the fan hub than the tips of the first fan blades disposed, which when implemented in a turbofan engine will avoid coincidence occurrences.

4 Claims, 6 Drawing Sheets

FAN ROTOR DESIGN FOR COINCIDENCE AVOIDANCE

FIELD OF USE

This invention relates particularly to fan rotors and, more particularly, to a fan rotor capable of avoiding coincidence.

BACKGROUND OF THE INVENTION

Present commercial engine configurations combine aerodynamic turning vanes and structural struts, used to support outer cases such as the fan containment case, into a single row of airfoils. This configuration utilizes a large number of airfoils relative to the fan blade count for acoustic reasons. With a high count of structural airfoils supporting the outer cases, a uniform stiffness is created at this engine axial station.

When a case is supported by a uniformly stiff structure, the case has the potential to exhibit vibratory modes with low to high nodal diameters. One or more of these vibratory modes may promote the potential for coincidence if they have the same frequency as an equivalent nodal diameter pattern on the rotor and the rotor is engaging the tip abradable system. Such an event is referred to as coincidence or a coincidence event. A coincidence event may occur if the energy transmission through rubbing continues to amplify the rotor to case interaction.

Conventional practice is to tune case modes out of the operating range by modifying the case thickness distribution or profile. This may be impractical for some modes, considering the weight addition required. In this situation, the standard approach to prevent coincidence is to open fan tip clearance. Opening fan tip clearance avoids the three hundred and sixty degree) (360° rubs, which can generate coincidence events. To avoid the potential for coincidence, fan tip clearances are opened up to prevent fan rubs greater than ninety degrees) (90°, that is, assuming difficult tolerance stack-up conditions and all potential field events. Typically, this tip clearance increase lowers fan blade efficiency by up to one percent (1%), increasing thrust specific fuel consumption by 0.5 to 0.6 percent, which significantly increases engine fuel burn.

Consequently, there exists a need for a fan rotor that addresses coincidence avoidance without sacrificing fan blade efficiency.

SUMMARY OF THE INVENTION

In accordance with the present invention, a fan rotor capable of avoiding coincidence broadly comprises a fan hub broadly comprising one or more slots each designed to receive a fan blade; and one or more of the fan blades disposed within the slots, wherein one or more of the slots broadly comprises a radius $R_{Z'}$ that corresponds to one or more second fan blades broadly comprising a second fan blade tip positioned at a distance farther from the fan hub than a first fan blade tip of one or more first fan blades disposed within one or more slots having a baseline $R_Z$.

In accordance with the present invention, a fan rotor capable of avoiding coincidence broadly comprises a fan hub broadly comprising one or more integrally disposed fan blades, wherein one or more of said integrally disposed fan blades broadly comprise one or more first fan blades broadly comprising a first fan blade tip position and one or more second fan blades broadly comprising a second fan blade tip position and said second fan blade tip position is at a farther distance from said fan hub than is said first fan blade tip position.

In accordance with the present invention, a fan rotor capable of avoiding coincidence broadly comprises a fan hub broadly comprising one or more fan blades disposed therein, wherein one or more of said fan blades broadly comprise one or more first fan blades broadly comprising a first fan blade tip position and one or more second fan blades machined shortened to a second fan blade tip position and said first fan blade tip position is at a farther distance from said fan hub than said second fan blade tip position.

In accordance with the present invention, a fan rotor capable of avoiding coincidence broadly comprises a fan hub comprising one or more slots capable of receiving one or more fan blades; and a fan platform disposed about a portion of one or more fan blades, wherein one or more fan blades fitted with the fan platform comprise a fan blade tip that projects outwardly at a distance farther from the fan hub than a fan blade tip of one or more fan blades without the fan platform.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

A first embodiment of fan rotor capable of avoiding coincidence will generally comprises a fan hub comprising one or more slots, each designed to receive a fan blade. A portion of the slots will comprise a slot having characteristic radius from the engine centerline $R_Z$ whereas another portion of the slots will comprise a slot having a radius $R_{Z'}$. The resulting difference ($\Delta R_Z$), with identical blades, will translate into a portion of the fan blades having a blade tip positioned at a distance farther from the fan hub, those blades disposed in slots having $R_{Z'}$, than fan blade tips of the remaining fan blades disposed within slots having $R_Z$. As a result, the second fan blade tips will make contact or rub with an abradable material disposed about the interior of the engine casing concentrically surrounding the engine and fan rotor.

Coincidence may occur when rotor and case vibratory modes have the same frequency, and there is a full circumferential rub. Energy is transmitted from the rotor to the case or vice versa during a rub. A full circumferential rub has the maximum energy transfer potential when all rotor blade to case clearances are uniform. An unstable coincidence event occurs when the full circumferential rub continues to increase the amplitude of rotor blade to case interaction. When employing one of the fan rotor embodiments described herein, the intermittent contact between the rotor blades and case minimizes the energy transfer. Accordingly, the rotor and case interaction amplitude will not amplify and a coincidence event will be avoided.

Figure 1:
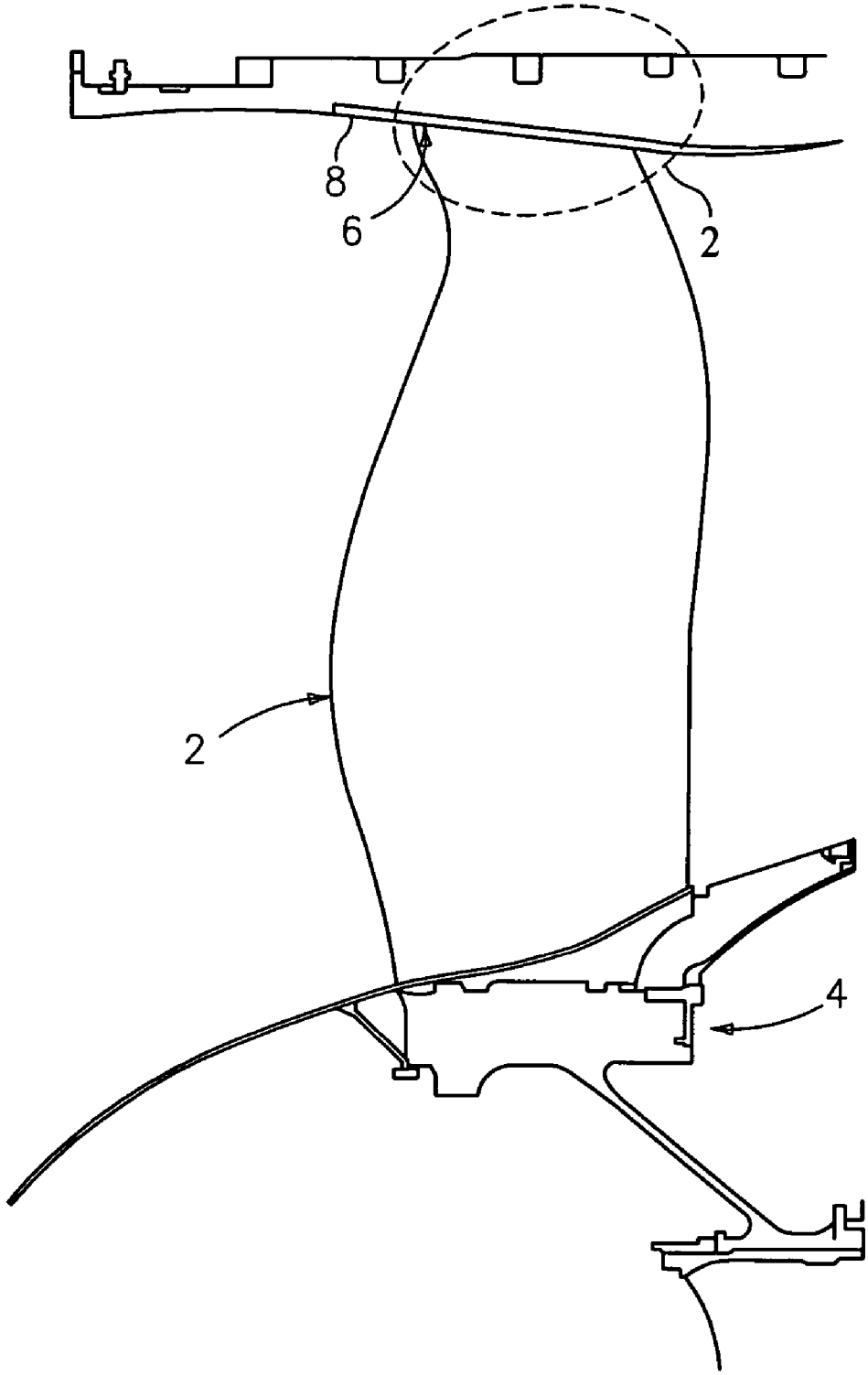
FIG. 1 is representation of a cross-sectional view of a a fan blade mounted within a fan rotor of a gas turbine engine housed within an engine casing.
Figure 2:
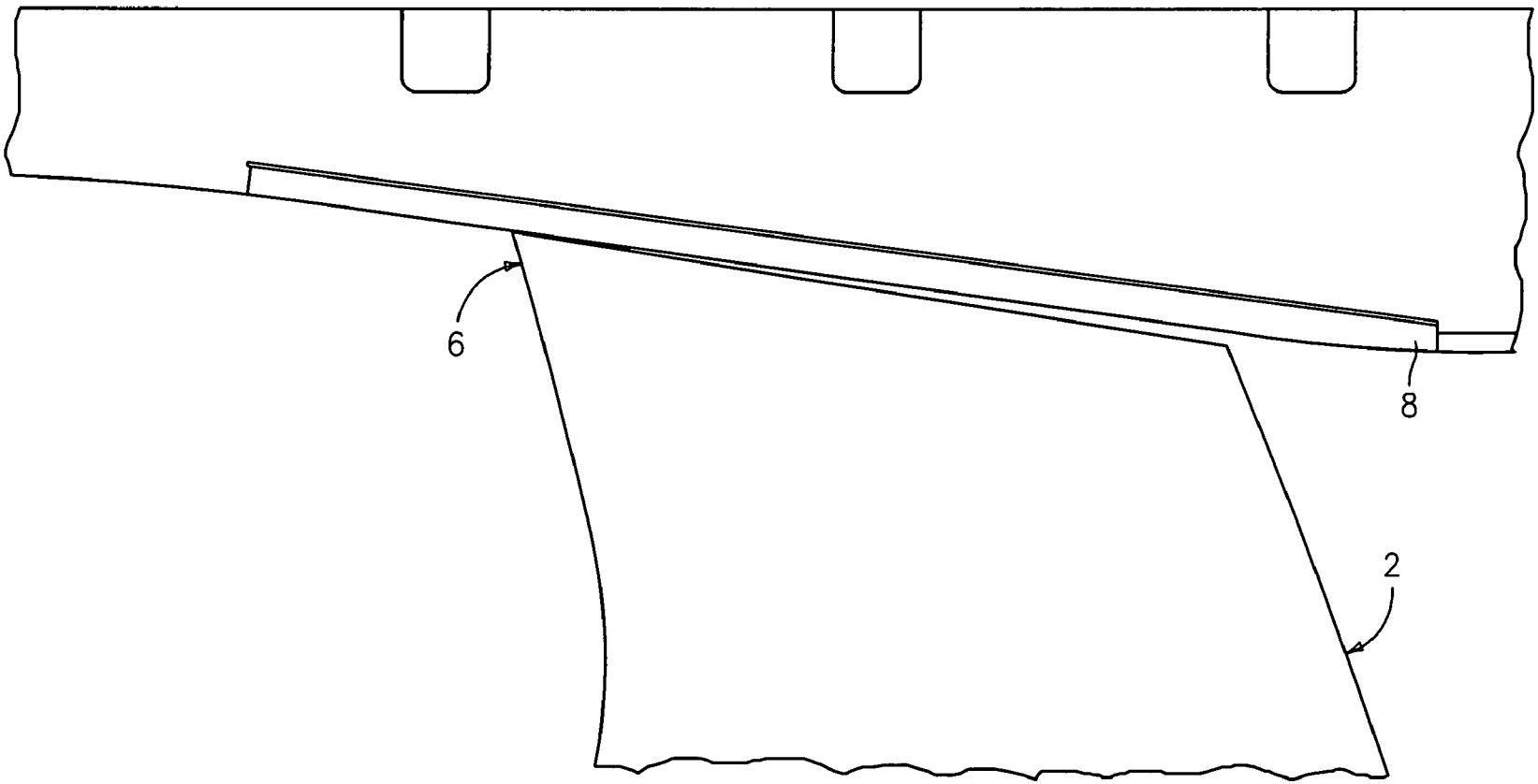
FIG. 2 is a representation of an enlarged area of FIG. 1 showing the disposition of the blade tip to the abradable material.
Figure 3:
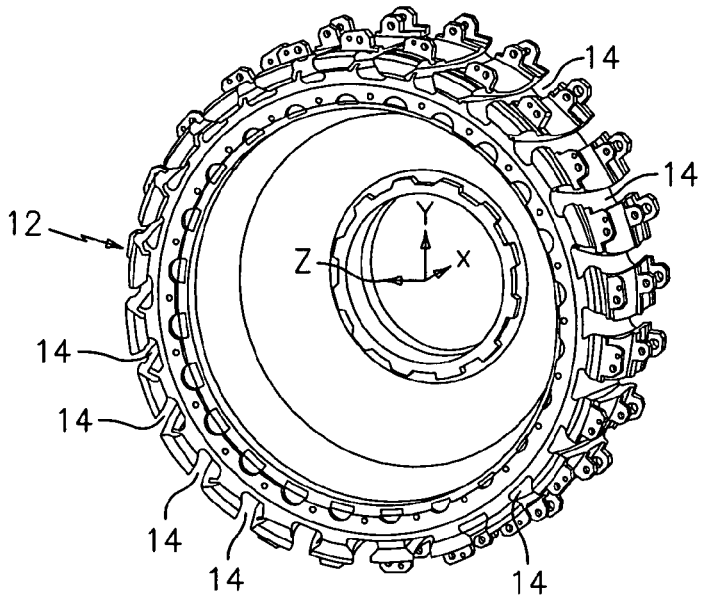
FIG. 3 is a representation of a fan hub of the present invention.
Figure 4:
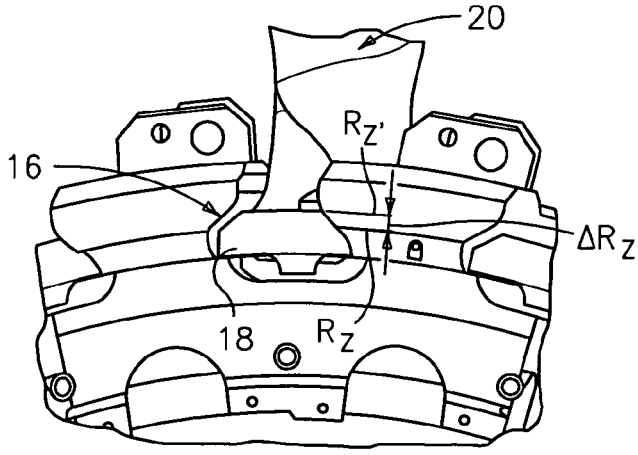
FIG. 4 is a representation of a second fan blade disposed within a slot of the fan hub of FIG. 3.

Referring generally to FIGS. 1 and 2, a representative cross-sectional view of a fan blade mounted within a fan rotor of a gas turbine engine housed within an engine casing is shown. A fan blade 2 may be disposed within a fan rotor 4 and mounted such that a blade tip 6 may be disposed proximate to an abradable material 8 concentrically disposed about the interior of an engine casing.

Referring generally now to FIGS. 3-8, a fan hub 12 of a fan rotor 10 of the present invention is illustrated. Fan hub 12 will comprise one or more slots 14 concentrically disposed about and integrally formed within a perimeter of fan hub 12. One or more first fan blades 22 and second fan blades 20 (FIG. 6) will be disposed within one or more slots 14. A portion of one or more slots 14 will comprise a slot 16 designed to receive a root section 18 of a second fan blade 20. In accordance with an X-Y-Z reference frame shown in FIG. 3, a Z-plane projects outward radially from the centerline of the engine. Slot 16 may be constructed as is understood to one of ordinary skill in the art to comprise a Z-plane embodying a radial shift. The radial shift $\Delta R_Z$ will be represented by the following equation:

$$\Delta R_Z = R_z - R_{Z'} \quad \text{(Equation 1)}$$

where $\Delta R_Z$ represents the radial difference between the shifted slot and the baseline slot within the Z plane. A portion of the slots, that is, slots 14, will comprise a slot having $R_Z$ whereas a portion of the slots, that is, slots 16, will comprise a slot having $R_{Z'}$ with identical blades 20 and 22 (e.g., having the same lengths L' and L from hub to tip). The resulting difference ($\Delta R_Z$) will translate into second fan blades 20 having a second blade tip 24 positioned at a distance farther from the centerline of the fan hub 12 than a first fan blade tip 26 of the first fan blades. As a result, the second fan blade tips will make contact, or rubs, with an abradable material 8 disposed about the interior of an engine casing (not shown) concentrically surrounding the engine (not shown) and fan rotor 10. The intermittent contact, or intermittent rubbing or simply "rubbing", of the second fan blade tips with the abradable material will reduce the vibratory modes between the fan rotor 10 and engine casing. As a result, energy transmitted through rubbing will not amplify the interaction between the fan rotor and engine casing, and will reduce and/or avoid coincidence of all three vibratory frequencies.

Figure 5:
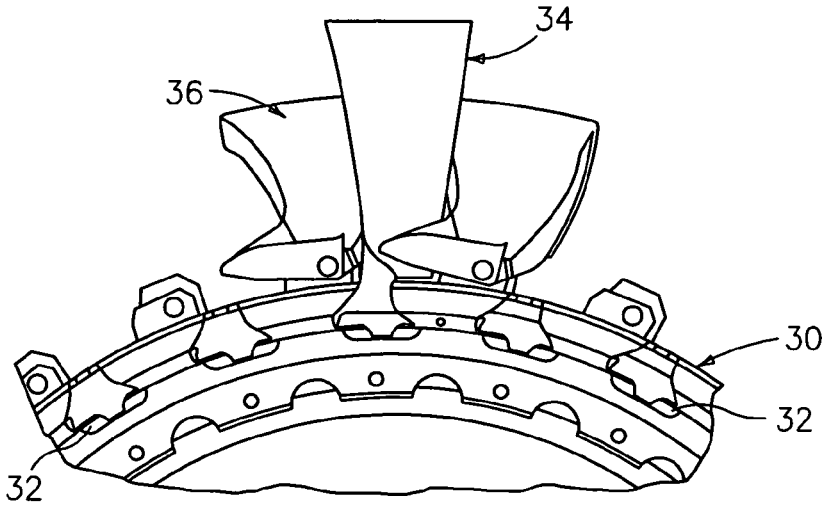
FIG. 5 is a representation of a fan blade disposed within a slot of the fan hub and secured in place by a fan platform.
Figure 6:
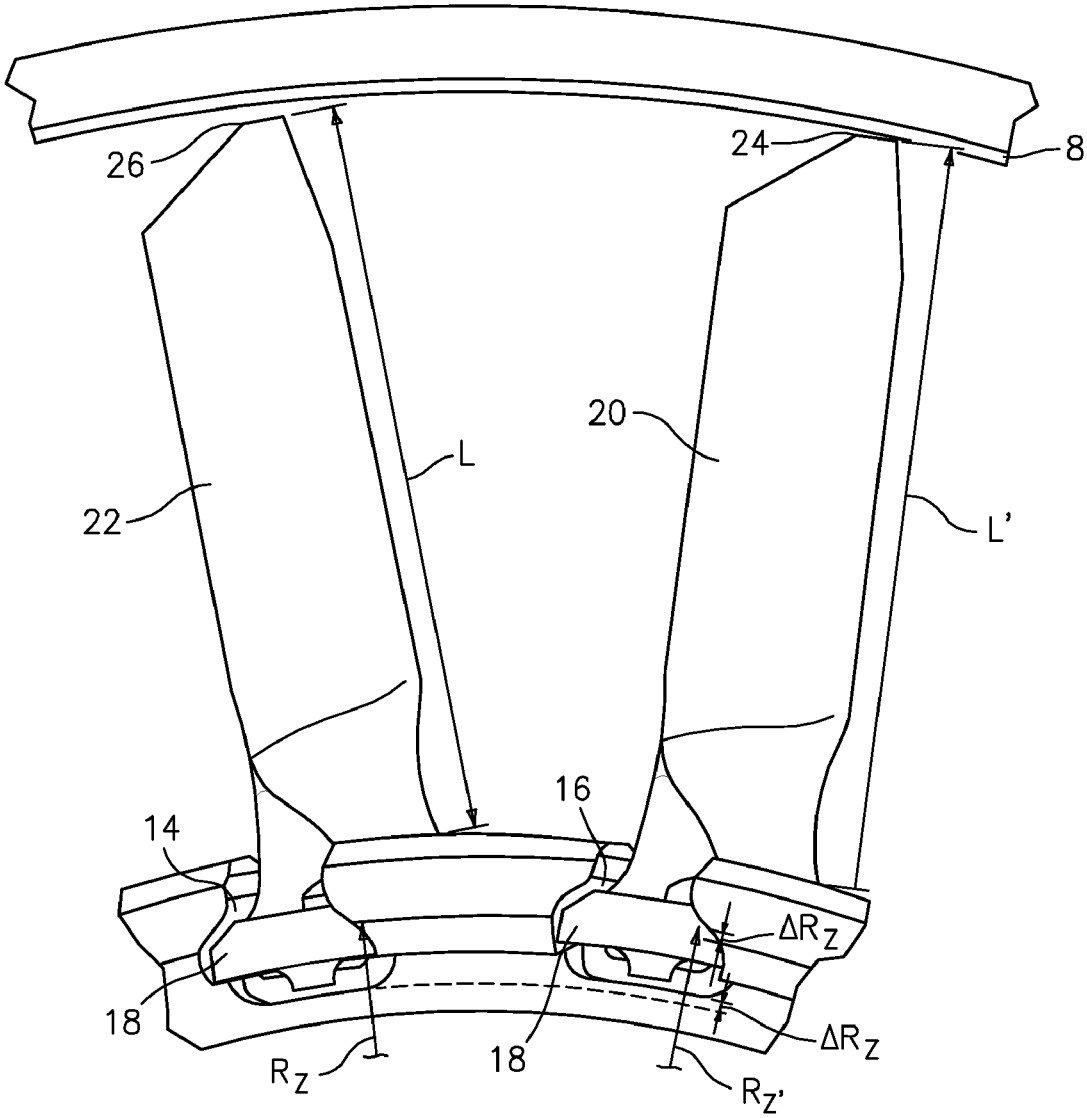
FIG. 6 is a representation of an exemplary embodiment of a fan rotor of the present disclosure.
Figure 7:
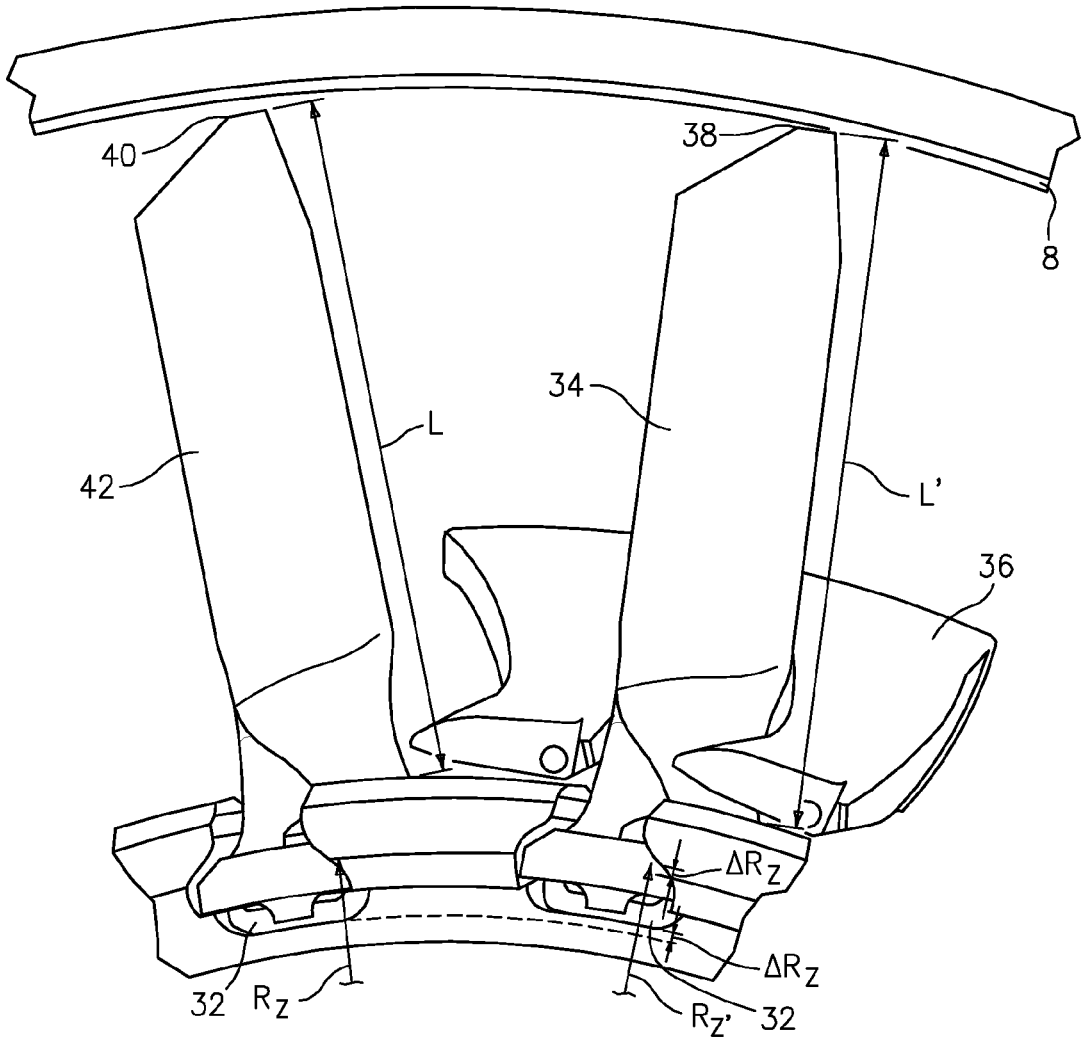
FIG. 7 is a representation of another exemplary embodiment of a fan rotor of the present disclosure.
Figure 8:
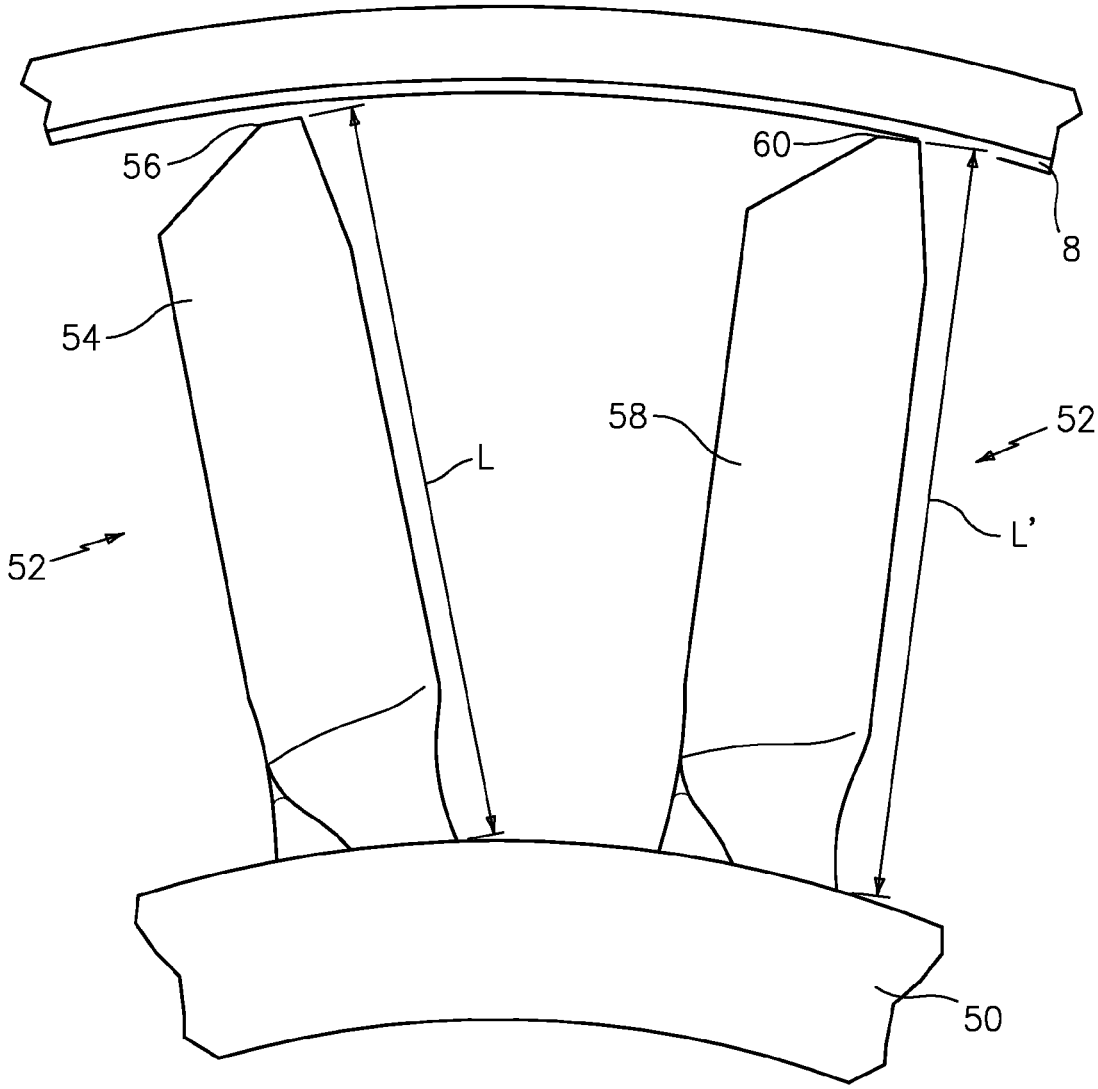
FIG. 8 is a representation of yet another exemplary embodiment of a fan rotor of the present disclosure.

Referring now to FIG. 5, in an alternative embodiment, a fan rotor capable of avoiding coincidence will comprise a fan hub 30 comprising one or more slots 32 capable of receiving one or more fan blades. A fan platform 36 will be disposed about a portion of one or more second fan blades 34. The second fan blades 34 fitted with fan platform 36 will possess a second fan blade tip 38 that projects outwardly at a distance farther from fan hub 30 than the other fan blade tips 40 of the remaining fan blades 42 (FIG. 7) not fitted with fan platform 36. Again, the second fan blade tips 38 will rub the abradable material 8 disposed about the interior of an engine casing (not shown) concentrically surrounding the engine (not shown) and fan rotor. The intermittent contact, or intermittent rubbing or simply "rubbing", of the second fan blade tips 38 with the abradable material 8 will reduce the vibratory modes between the fan rotor and engine casing. As a result, energy transmitted through rubbing will not amplify the interaction between the fan rotor and engine casing, and will reduce and/or avoid coincidence of all three vibratory frequencies.

In another alternative embodiment, a fan rotor capable of avoiding coincidence will comprise a fan hub 50 (FIG. 8) comprising one or more integrally disposed fan blades 52. In this embodiment, the fan hub 50 and blades 52 form a single turbine engine component. One or more of the integrally disposed fan blades 52 will comprise one or more first fan blades 54 comprising a first fan blade tip position 56, and one or more second fan blades 58 comprising a second fan blade tip position 60. The second fan blade tip position 60 will be at a distance farther from the fan hub than the first fan blade tip position 56. Rather than altering the manufacture of the slots within the fan hub 50, the second fan blades 58 will comprise a second fan blade length L' that is greater than a first fan blade length L of the first fan blades 54. Again, the second fan blade tips will rub the abradable material 8 disposed about the interior of an engine casing (not shown) concentrically surrounding the engine (not shown) and fan rotor. The intermittent contact, or intermittent rubbing or simply "rubbing", of the second fan blade tips with the abradable material will reduce the vibratory modes between the fan rotor and engine casing. As a result, energy transmitted through rubbing will not amplify the interaction between the fan rotor and engine casing, and will reduce and/or avoid coincidence of all three vibratory frequencies.

In yet another alternative embodiment, a fan rotor capable of avoiding coincidence will comprise a fan hub comprising one or more fan blades disposed therein. One or more of the fan blades comprise one or more first fan blades comprising a first fan blade tip position, and one or more second fan blades machined shortened to a second fan blade tip position. The second fan blades will be machine shortened to a length that is less than a length of the first fan blades. As a result, the first fan blade tip positions will be at a distance farther from the fan hub than the second fan blade tip positions. Again, the first fan blade tips will rub the abradable material (not shown) disposed about the interior of an engine casing (not shown) concentrically surrounding the engine (not shown) and fan rotor. The intermittent contact, or intermittent rubbing or simply "rubbing", of the first fan blade tips with the abradable material will reduce the vibratory modes between the fan rotor and engine casing. As a result, energy transmitted through rubbing will not amplify the interaction between the fan rotor and engine casing, and will reduce and/or avoid coincidence.

The fan rotors of the various embodiments described herein will not only prevent and/or avoid the potential for the coincidence of the vibratory frequency modes, but also improve turbine engine efficiency and performance. As described earlier, conventional practice to prevent coincidence is to fully open fan tip clearance. However, this practice results in lowered fan blade efficiency by up to one percent (1%), resulting in a 0.5 to 0.6 percent loss of thrust specific fuel consumption. In contrast, the fan rotors described herein will not require opening fan tip clearances. The estimated impact upon fan blade efficiency will be about 0.2 percent (0.2%). When compared to an actual loss of one percent, the fan rotors described herein provide a net gain of about 0.8 percent (0.8%) in fan blade efficiency.

It is to be understood that the invention is not limited to the illustrations described and shown herein, which are deemed to be merely illustrative of the best modes of carrying out the invention, and which are susceptible to modification of form, size, arrangement of parts, and details of operation. The invention rather is intended to encompass all such modifications which are within its spirit and scope as defined by the claims.

What is claimed is:

1. A fan rotor capable of avoiding coincidence, comprising:

a fan hub comprising a plurality of slots; and a plurality of fan blades, each having a root received in a respective said slot in the same annular row of fan blades, wherein: said plurality of slots include at least one first slot having a characteristic radius $R_z$ and at least one second slot having a characteristic radius $R_{z'}$ greater than $R_z$;

said plurality of fan blades includes at least one first fan blade, the root of which is received in the at least one first slot and at least one second fan blade, the root of which is received in the at least one second slot, all of said at least one first fan blade and said at least one second fan blade having an equivalent fan blade length so that a tip of the at least one second fan blade is positioned farther from an axis of the rotor than is a tip of the at least one first fan blade.

2. A gas turbine engine comprising:

the fan rotor of claim 1; and a case surrounding the blades.

3. A gas turbine engine fan rotor comprising:

a fan hub having a plurality of slots; and a plurality of fan blades, including first fan blades and second fan blades each having a root received in a respective said slot in a single stage of said fan blades, wherein:

said plurality of slots include at least one first slot having a first characteristic radius from an axis of the rotor and at least one second slot having a second characteristic radius from said axis, said second characteristic radius being greater than said first characteristic radius; and the plurality of fan blades all have an equivalent fan blade length to each other so that tips of the second fan blades are positioned farther from the axis than tips of the first fan blades.

4. A gas turbine engine comprising:

the gas turbine engine fan rotor of claim 3; and a case surrounding the blades.

* * * * *